US007588093B2

(12) United States Patent
Grand et al.

(10) Patent No.: US 7,588,093 B2
(45) Date of Patent: Sep. 15, 2009

(54) IMPACT MECHANISM

(76) Inventors: Gerard M. Grand, 299 Riverview Blvd., St. Catharines, Ontario (CA) L2T 3N3; Fern Beauchamp, 299 Riverview Blvd., St. Catharines, Ontario (CA) L2T 3N3

( * ) Notice: Subject to any disclaimer, the term of this patent is extended or adjusted under 35 U.S.C. 154(b) by 40 days.

(21) Appl. No.: 12/036,252

(22) Filed: Feb. 23, 2008

(65) Prior Publication Data

US 2009/0056966 A1 Mar. 5, 2009

Related U.S. Application Data

(60) Provisional application No. 60/970,259, filed on Sep. 5, 2007, now abandoned.

(51) Int. Cl.
*B25D 11/00* (2006.01)

(52) U.S. Cl. ..... 173/29; 173/93; 173/93.5; 173/109

(58) Field of Classification Search ..... 173/29, 173/128, 93, 93.5, 93.6, 109, 48, 114, 124, 173/205

See application file for complete search history.

(56) References Cited

U.S. PATENT DOCUMENTS 2,227,627 A * 1/1941 Bruzon ..... 173/93.6
2,794,621 A * 6/1957 Beeson ..... 173/109
2,940,565 A * 6/1960 Schodeberg ..... 173/93.6
3,163,237 A * 12/1964 Fulon ..... 173/109
4,489,792 A * 12/1984 Fahim et al. ..... 173/48
5,601,149 A * 2/1997 Kawasaki et al. ..... 173/93.5
5,711,380 A * 1/1998 Chen ..... 173/48
5,908,076 A * 6/1999 Marcengill et al. ..... 173/93
5,992,538 A * 11/1999 Marcengill et al. ..... 173/93
6,138,772 A * 10/2000 Miescher et al. ..... 173/93.5
6,223,834 B1 * 5/2001 Takamura et al. ..... 173/93.5
6,684,964 B2 * 2/2004 Ha ..... 173/29
7,048,075 B2 * 5/2006 Saito et al. ..... 173/93.5

* cited by examiner

*Primary Examiner*—Scott A. Smith

(57) ABSTRACT

An impact mechanism comprises a drive motor engaging member and a tool bit retaining member rotatably inter-connected therewith. The tool bit retaining member has a main body portion, an anvil portion securely attached thereto for co-rotation therewith, and a tool bit retaining portion securely attached thereto for co-rotation with the main body portion. A hammer member is mounted on the drive engaging member for movement between an anvil contact position wherein force is transmitted from the hammer member to the anvil portion, and a release position whereat the hammer member is temporarily removed from the anvil portion. A spring biases the hammer member to the anvil contact position. In use, the hammer member to move from its anvil contact position towards its release position, wherein the hammer member is propelled by the spring and the rotation of the drive engaging member to impact on the anvil portion.

28 Claims, 11 Drawing Sheets

20

20

20

20

IMPACT MECHANISM

This application is a non-provisional application claiming priority to U.S. provisional patent application Ser. No. 60/970,259 filed on Sep. 5, 2007 now abandoned, which is herein incorporated by reference.

FIELD OF THE INVENTION

The present invention relates to impact mechanisms, and more particularly to impact mechanisms that are selectively mountable on an electric drill or the like.

BACKGROUND OF THE INVENTION

It is known to use a series of impacts of a hammer member on an anvil member to provide a significant force and highly effective rotational force in an impact driver. However, it is not known in the prior art to provide a portable assembly that is operatively engageable with the chuck of an electric drill or the like, which assembly provides a high impact rotational force, for turning a threaded fastener into a receiving article, such as a piece of wood, or removing a threaded fastener from a co-operating threaded shaft, and so on. It is also not known in the prior art to be able to readily adjust the impact rotational force of the impact driver.

It is an object of the present invention to provide a portable impact driver that is operatively engageable with the chuck of an electric drill or the like, which impact driver provides a high impact rotational force.

It is another object of the present invention to provide a portable impact driver that is operatively engageable with the chuck of an electric drill or the like, wherein it is possible to readily adjust the impact rotational force of the impact driver.

SUMMARY OF THE INVENTION

In accordance with one aspect of the present invention there is disclosed a novel impact mechanism for use with a drive motor. The impact mechanism comprises a drive engaging member for engaging a rotatable output of a drive motor for rotation therewith about a longitudinal axis. A tool bit retaining member is operatively inter-connected with the drive engaging member for rotation with respect to the drive engaging member about the longitudinal axis. The tool bit retaining member has a main body portion, an anvil portion securely attached thereto for co-rotation with the main body portion, and a tool bit retaining means securely attached thereto for co-rotation with the main body portion. A hammer member is mounted on one of the drive engaging member and the tool bit retaining member for movement between an anvil contact position whereat force is transmitted from the hammer member to the anvil portion so as to create a moment about the longitudinal axis, and a release position whereat the hammer member is temporarily removed from the anvil portion. There is a guide means for moving the hammer member between the anvil contact position and the release position when the drive engaging member is rotated with respect to the tool bit retaining member. A spring means is operatively interconnected between the drive engaging member and the hammer member for biasing the hammer member to the anvil contact position. In use, rotation of the drive engaging member about the longitudinal axis causes the hammer member to move from its anvil contact position towards its release position, thereby storing potential energy in the spring means. When the hammer member reaches the release position, the hammer member is forcefully propelled by the spring means and the rotation of the drive engaging member to impact on the anvil portion, thus urging the tool bit retaining member to forcefully rotate about the longitudinal axis.

Other advantages, features and characteristics of the present invention, as well as methods of operation and functions of the related elements of the structure, and the combination of parts and economies of manufacture, will become more apparent upon consideration of the following detailed description and the appended claims with reference to the accompanying drawings, the latter of which is briefly described herein below.

BRIEF DESCRIPTION OF THE DRAWINGS

The novel features which are believed to be characteristic of the impact mechanism according to the present invention, as to its structure, organization, use and method of operation, together with further objectives and advantages thereof, will be better understood from the following drawings in which a presently preferred embodiment of the invention will now be illustrated by way of example. It is expressly understood, however, that the drawings are for the purpose of illustration and description only, and are not intended as a definition of the limits of the invention. In the accompanying drawings.

DETAILED DESCRIPTION OF THE PREFERRED EMBODIMENTS

Figure 17:
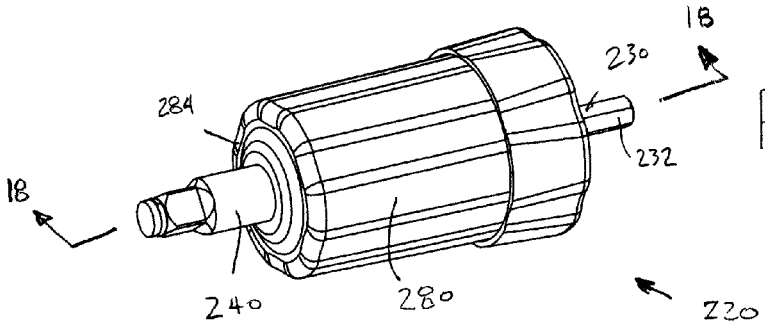
FIG. 17 is a perspective view from the front of the second preferred embodiment of the impact mechanism according to the present invention.
Figure 18:
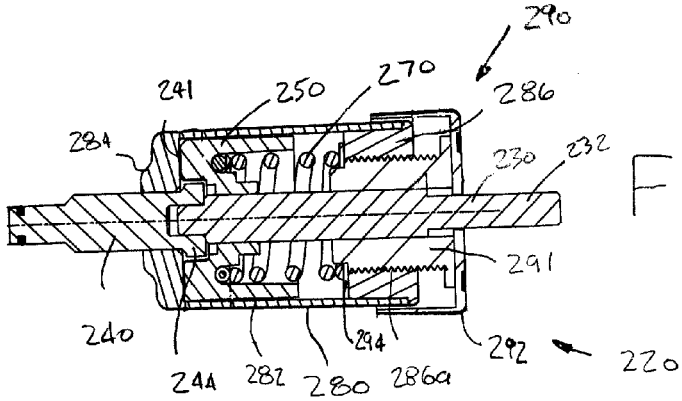
FIG. 18 is a sectional side elevational view of the second preferred embodiment of the impact mechanism of FIG. 17, taken along section line 18-18; and, FIG. 19 is a sectional side elevational view similar to FIG. 18, but with the coil spring having been further compressed by the spring compression mechanism.
Figure 19:
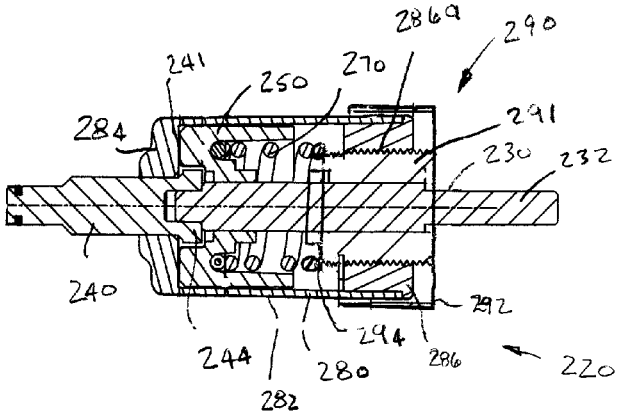

Referring to FIGS. 1 through 19 of the drawings, it will be noted that FIGS. 1 through 16 illustrate a first preferred embodiment of the impact mechanism of the present invention, and FIGS. 17 through 19 illustrate a second preferred embodiment of the impact mechanism of the present invention.

Reference will now be made to FIGS. 1 through 16, which show a first preferred embodiment of the impact mechanism of the present invention, as indicated by general reference numeral 20. The impact mechanism 20 is for use with a drive motor 22. The impact mechanism 20 comprises a drive engaging member 30 for engaging a rotatable output, such as a chuck 24, of a drive motor 22, such as an electric drill, for rotation therewith about a longitudinal axis "L" about which the drive engaging member 30 rotates.

In the first preferred embodiment as illustrated, the drive engaging member 30 comprises a chuck-engageable portion 32 for engagement into the chuck of a drill (not shown). The chuck-engageable portion 32 is preferably hexagonally shaped, or of any other suitable shape, for secure engagement into the chuck of a drill for rotation therewith.

The drive engaging member 30 further comprises a forward shaft portion 34 and a cylindrical protrusion 33 that extends forwardly from the forward shaft portion 34 such that the forward shaft portion 34 is disposed immediately rearwardly of the front cylindrical protrusion 33. The forward shaft portion 34 is preferably substantially cylindrical. The drive engaging member 30 further comprises an intermediate shaft portion 36 disposed between the forward shaft portion 34 and the chuck-engageable portion 32, and is also preferably substantially cylindrical. As can be seen in the drawings, the intermediate shaft portion 36 has a larger diameter than the forward shaft portion 34.

There is also a tool bit retaining member 40 operatively inter-connected with the drive engaging member 30 for rotation with respect to the drive engaging member 30 about the longitudinal axis. As can be seen in the Figures, the drive engaging member 30 is disposed immediately rearwardly of the tool bit retaining member 40. The tool bit retaining member 40 has a main body portion 42, an anvil portion 44 securely attached thereto for co-rotation with the main body portion 42, and a tool bit retaining means 46 securely attached thereto for co-rotation with the main body portion 42.

The tool bit retaining member 40 has a rear recess 48 therein at the longitudinal axis "L". The front cylindrical protrusion 33 of the drive engaging member 30 is shaped and dimensioned for free rotational engagement in the rear recess 48 of the tool bit retaining member 40. In this manner, the drive engaging member 30 and the tool bit retaining member 40 can rotate each with respect to the other about the longitudinal axis "L", and also remain axially aligned.

Figure 1:
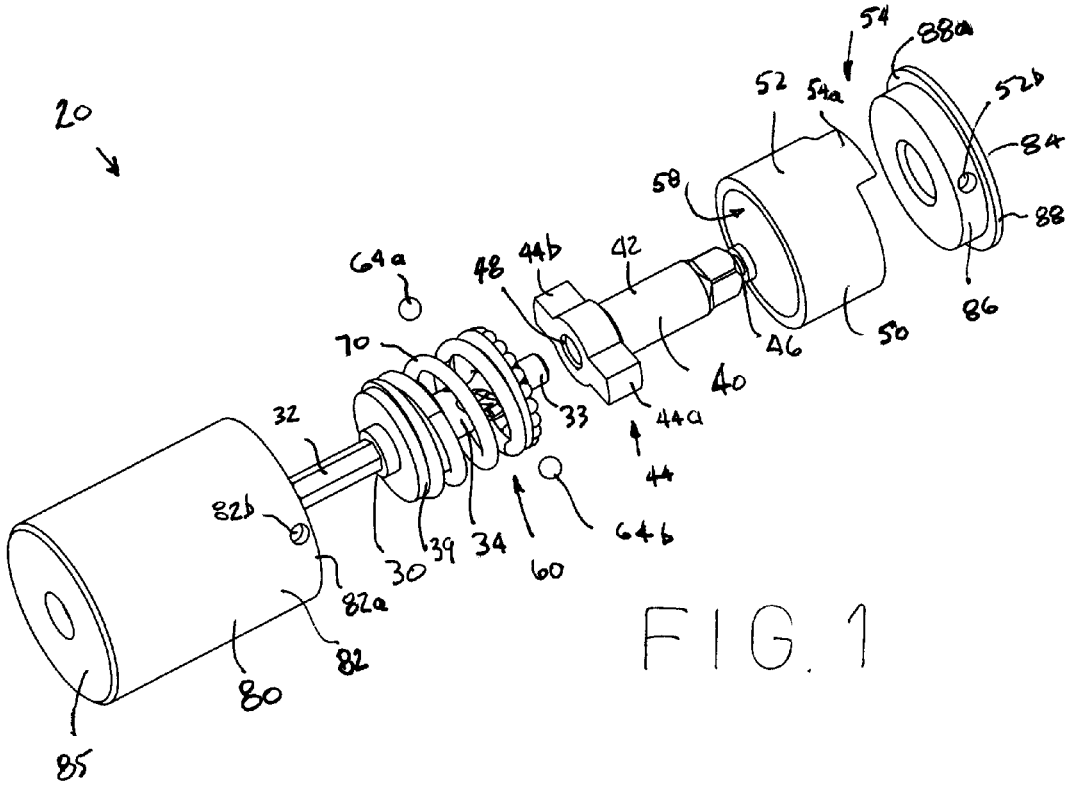
FIG. 1 is an exploded perspective view from the front of the first preferred embodiment of the impact mechanism according to the present invention.
Figure 2:
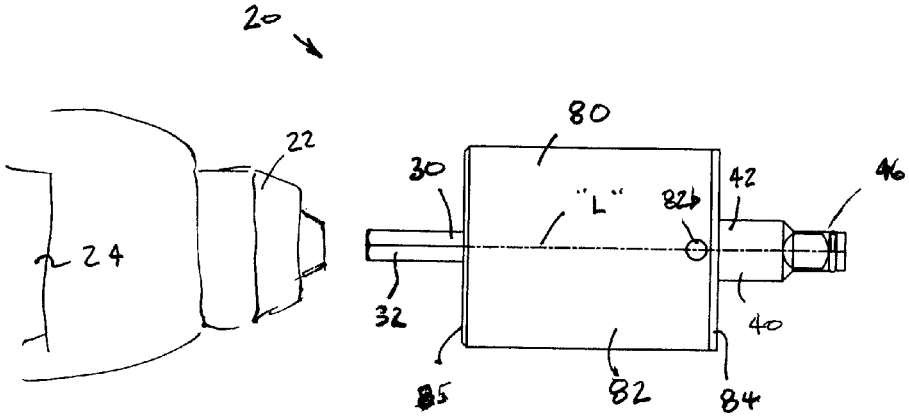
FIG. 2 is a side elevational view of the first preferred embodiment of the impact mechanism of FIG. 1.
Figure 3:
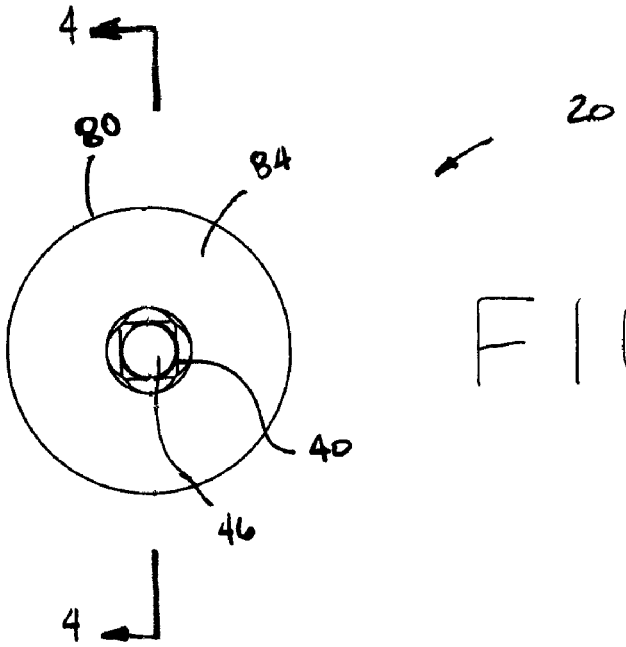
FIG. 3 is front end view of the first preferred embodiment of the impact mechanism of FIG. 1.
Figure 8:
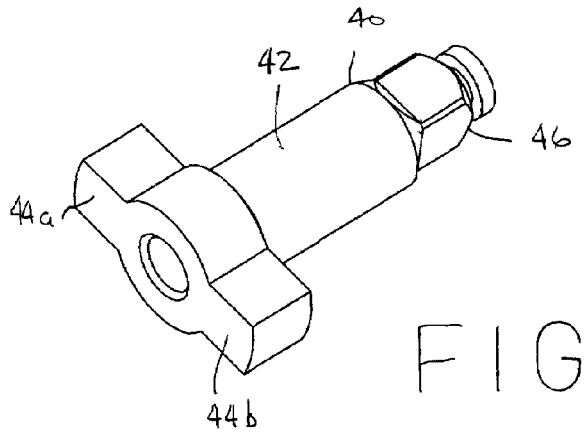
FIG. 8 is a perspective view of the tool bit retaining member of the first preferred embodiment of the impact mechanism of FIG. 1.
Figure 9:
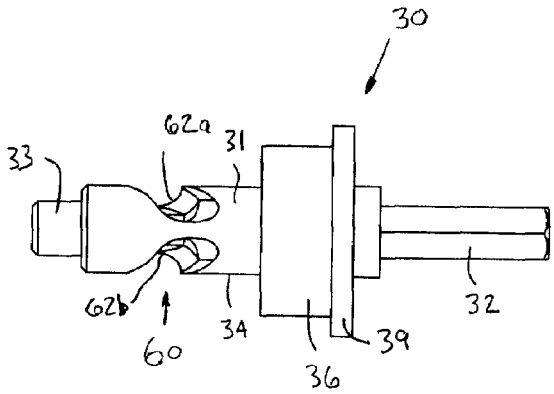
FIG. 9 is a side elevational view of the drive engaging member of the first preferred embodiment of the impact mechanism of FIG. 1.
Figure 10:
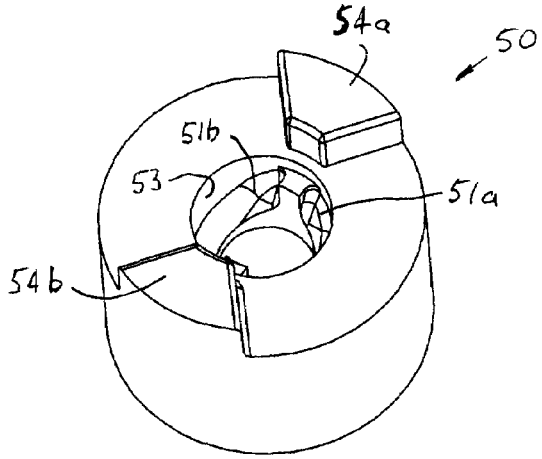
FIG. 10 is a perspective view of the hammer member of the first preferred embodiment of the impact mechanism of FIG. 1.

As can be best seen in FIGS. 1 and 8, the anvil portion 44 is integrally formed with the tool bit retaining member 40. Preferably, the anvil portion 44 comprises first and second squared anvils 44*a*,44*b* disposed at the back end of the tool bit retaining member 40. Each of the first and second squared anvils 44*a*,44*b* projects radially outwardly from the main body portion 42 of the tool bit retaining member 40.

Figure 4:
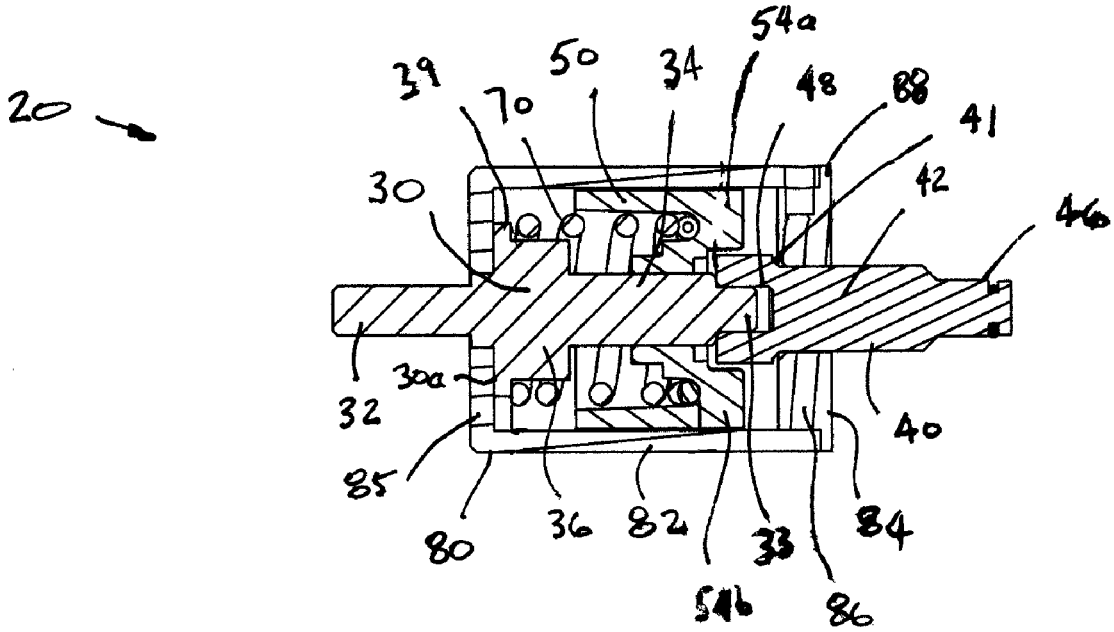
FIG. 4 is a sectional side elevational view of the first preferred embodiment of the impact mechanism of FIG. 1, taken along section line 4-4 of FIG. 3, and with the hammer member in its anvil contact position.
Figure 5:
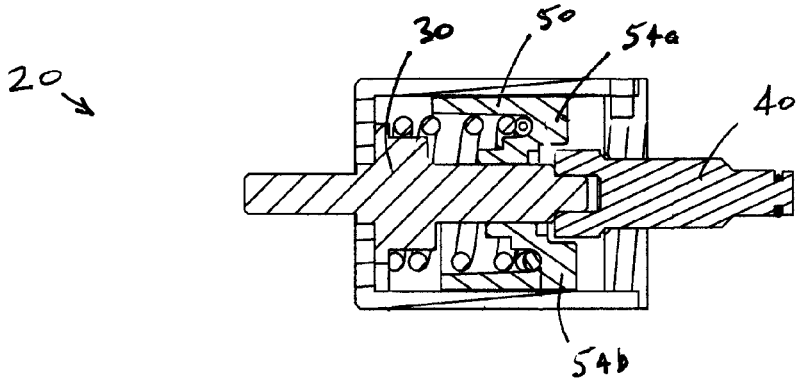
FIG. 5 is a sectional side elevational view similar to FIG. 4, but with the hammer member travelling from its anvil contact position towards its release position.
Figure 6:
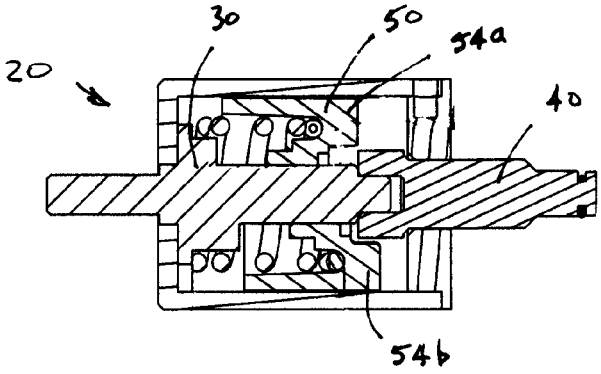
FIG. 6 is a sectional side elevational view similar to FIG. 5, but with the hammer member having reached its release position.
Figure 7:
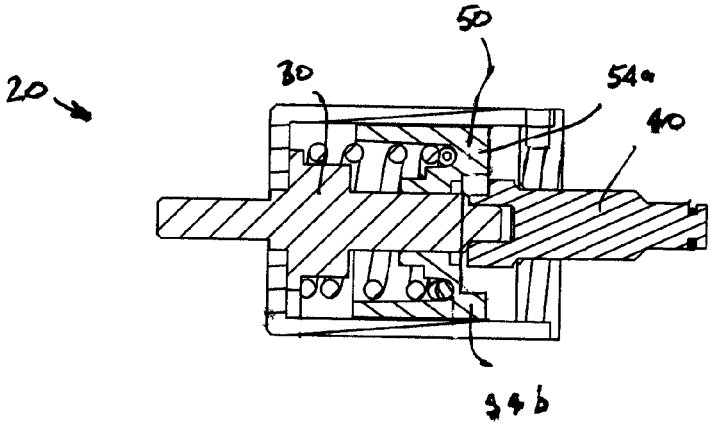
FIG. 7 is a sectional side elevational view similar to FIG. 6, but with the hammer member moving forwardly and rotationally to its anvil contact position, on the next anvil.
Figure 11:
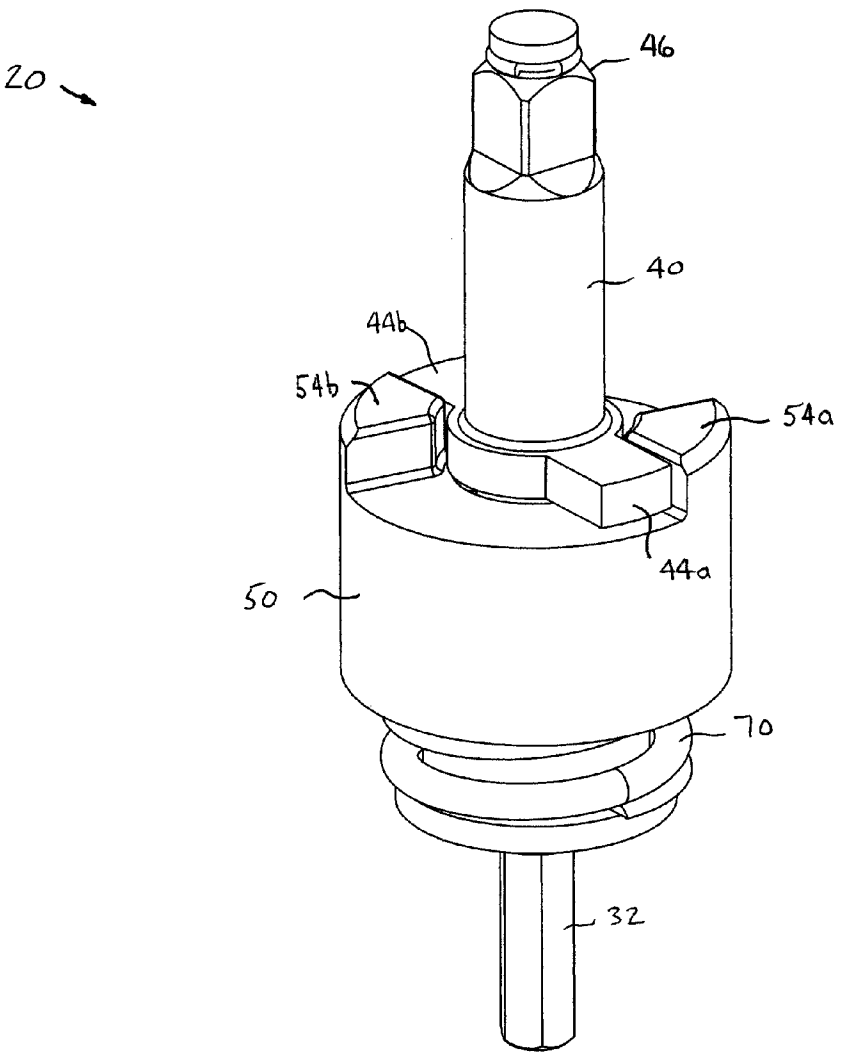
FIG. 11 is a perspective view of the first preferred embodiment of the impact mechanism of FIG. 1, with the housing removed for the sake of clarity, and with the hammer member in its anvil contact position.
Figure 12:
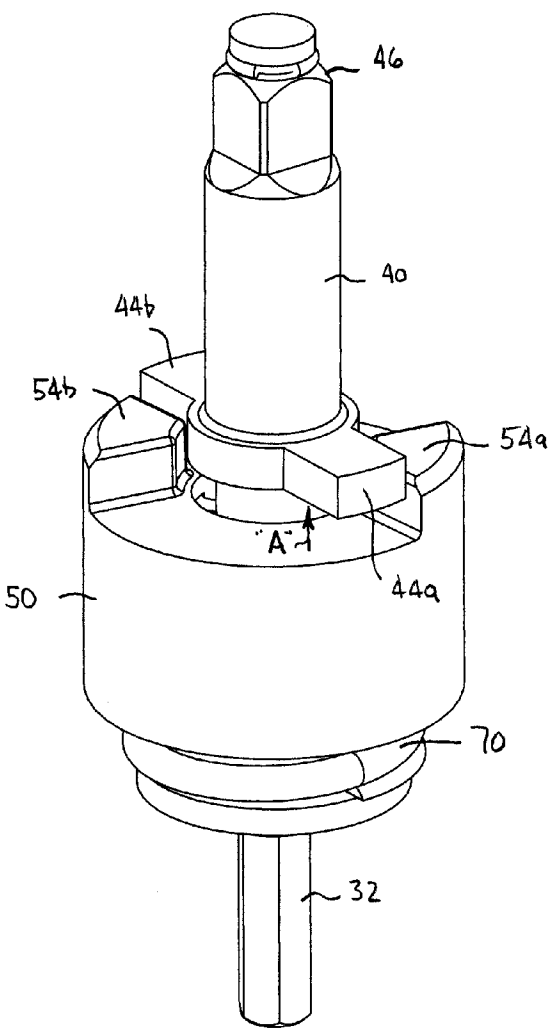
FIG. 12 is a perspective view similar to FIG. 11, but with the hammer member travelling from its anvil contact position towards its release position.
Figure 13:
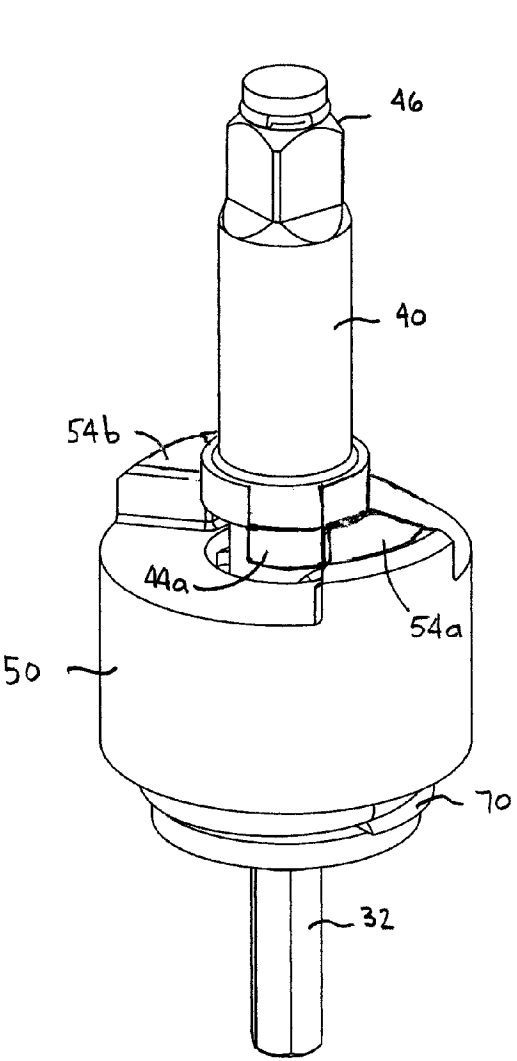
FIG. 13 is a perspective view similar to FIG. 12, but with the hammer member having just reached its release position.

A hammer member 50 is mounted on one of the drive engaging member 30 and the tool bit retaining member 40 for movement between an anvil contact position, as can be best seen in FIGS. 4 and 11, and a release position, as can be best seen in FIGS. 6 and 13. In the anvil contact position, force is transmitted from the hammer member 50 to the anvil portion 44 so as to create a moment about the longitudinal axis. In the release position, the hammer member 50 is temporarily removed from the anvil portion 44.

The hammer member 50 preferably comprises an annular main body 52 and at least one hammer head portion 54 projecting forwardly from the annular main body 52. In the first preferred embodiment, as illustrated, the at least one hammer head portion 54 comprises first and second hammer head portions 54*a*,54*b* projecting forwardly from the annular main body 52. The annular main body 52 and the first and second hammer head portions 54*a*,54*b* are integrally formed one with the others for reasons of ease of manufacturing and structural strength and rigidity. Preferably, the hammer member 50 is more massive than the anvil portion 44 of the tool bit retaining member 40, in order to be able to impart sufficient energy to the anvil portion 44 when the hammer member 50 impacts the anvil portion 44.

There is also a guide means 60 for moving the hammer member 50 between the anvil contact position and the release position when the drive engaging member 30 is rotated with respect to the tool bit retaining member 40. The guide means 60 is disposed on the forward shaft portion 34 and comprises first and second "V"-shaped grooves 62*a*,62*b* in the outer surface 31 of the forward shaft portion 34, a co-operating first and second races 51*a*,51*b* in an interior surface 53 of the hammer member 50. A first ball bearing 64*a* is operatively engaged in the first "V"-shaped groove 62*a* and the first race 51*a*. Similarly, a second ball bearing 64*b* is operatively engaged in the second "V"-shaped groove 62*b* and the second race 51*b*. As can be seen in FIGS. 4 through 7, the hammer member 50 surrounds the drive engaging member 30 and is retained in space relation from the drive engaging member 30 by the first and second ball bearings 64*a*,64*b*.

There is a spring means 70 operatively interconnected between the drive engaging member 30 and the hammer member 50 for biasing the hammer member 50 to the anvil contact position. The spring means 70 preferably comprises a coil spring, but may alternatively comprising the other suitable type of spring. The coil spring 70 fits in close relation around the intermediate shaft portion 36.

The drive engaging member 30 further comprises a spring retaining disk portion 39 projecting radially outwardly from the intermediate shaft portion 36. The spring means 70 is received and retained between the spring retaining disk portion 39 and a co-operating annular recess 58 in the hammer member 50. Preferably, the spring means 70 is in compression when the impact mechanism 20 is at rest, so as to increase the amount of potential energy that is temporarily gained by the coil spring 70 when the hammer member 50 moves from its anvil contact position to its release position.

The impact mechanism 20 further comprises a housing 80 substantially surrounding the drive engaging member 30 forwardly of the chuck-engageable portion 32, the anvil portion 44 of the tool bit retaining member 40, the hammer member 50, and the spring means 70. The housing 80 comprises an outer annular portion 82, a front end portion 84, and a back end portion 85. The front end portion 84 comprises a removable and replaceable end cap 84 having an annular main body portion 86 and a forwardly disposed annular flange portion 88. The annular main body portion 86 resides within the interior of the outer annular portion 82 of the housing 80. The front surface 82*a* of the outer annular portion 82 of the housing 80 abuts against the rearwardly facing surface 88*a* of the annular flange portion 88. The end cap 84 is retained in place by threaded fasteners (not specifically shown) that extend through apertures 82*b* in the front end of the outer annular portion 82 of the housing 80 and threadibly engage co-operating apertures 52*b* in the annular main body 52 of the end cap 84.

As can be seen in FIG. 4, the front end portion 84 bears against a forwardly facing surface 41 on the tool bit retaining member 40 and the back end portion 85 bears against a rearwardly facing surface 30*a* on the drive engaging member 30, to thereby retain the housing 80 in place and to keep the tool bit retaining member 40 operatively inter-connected with the drive engaging member 30.

Reference will now be made to FIGS. 11 through 16, which show the impact mechanism 20 in use, with the housing 80 removed for the sake of clarity. In use, rotation of the drive engaging member 30 about the longitudinal axis "L" causes the hammer member 50 to move from its anvil contact position, as can be best seen in FIG. 11, towards its release position, as indicated by arrow "A" in FIG. 12. Accordingly, potential energy is stored in the spring means 70, until the hammer member 50 reaches its release position, as is shown in FIG. 13.

Figure 14:
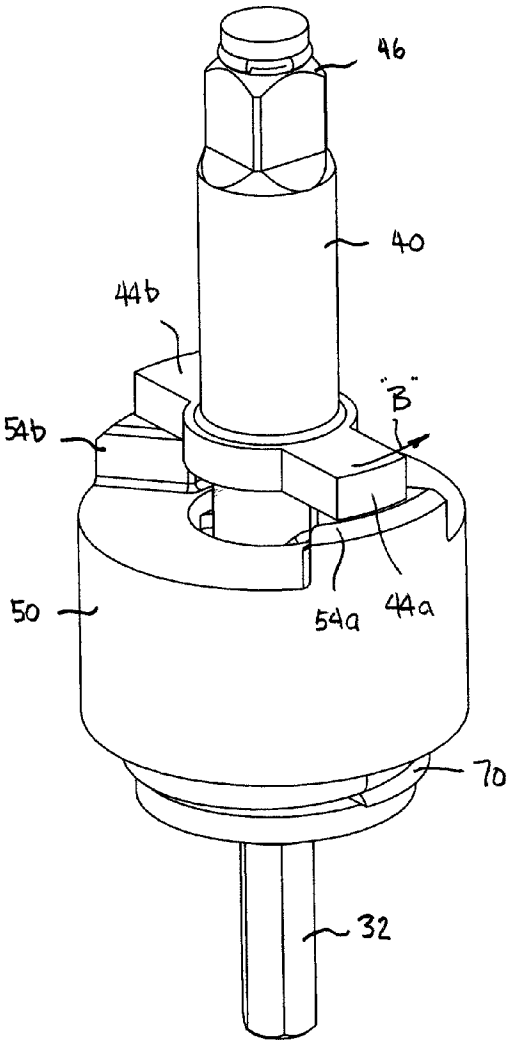
FIG. 14 is a perspective view similar to FIG. 13, but with the hammer member moving rotationally over the anvil portion, and towards its anvil contact position on the next anvil.
Figure 15:
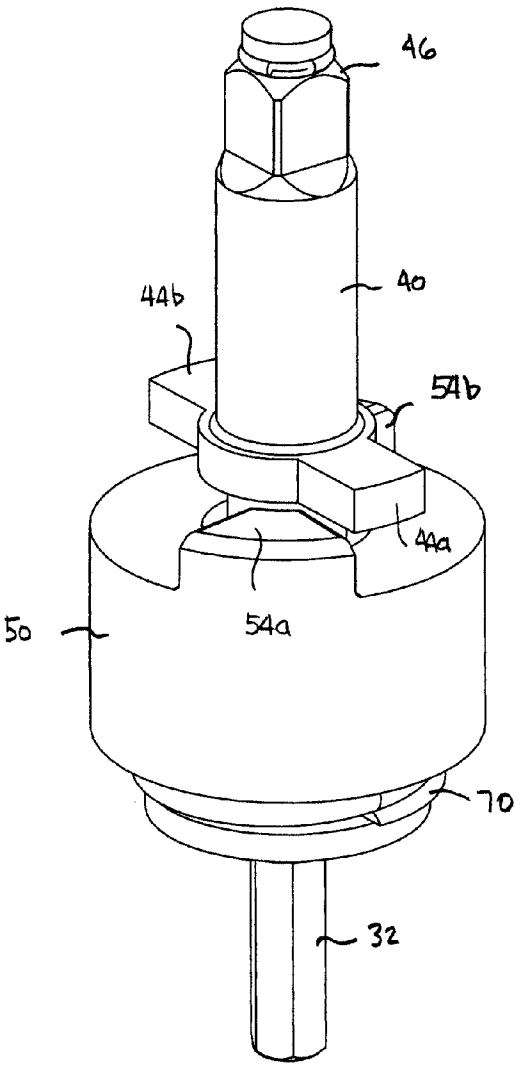
FIG. 15 is a perspective view similar to FIG. 14, but with the hammer member having moved rotationally off the anvil portion, and towards its anvil contact position on the next anvil.
Figure 16:
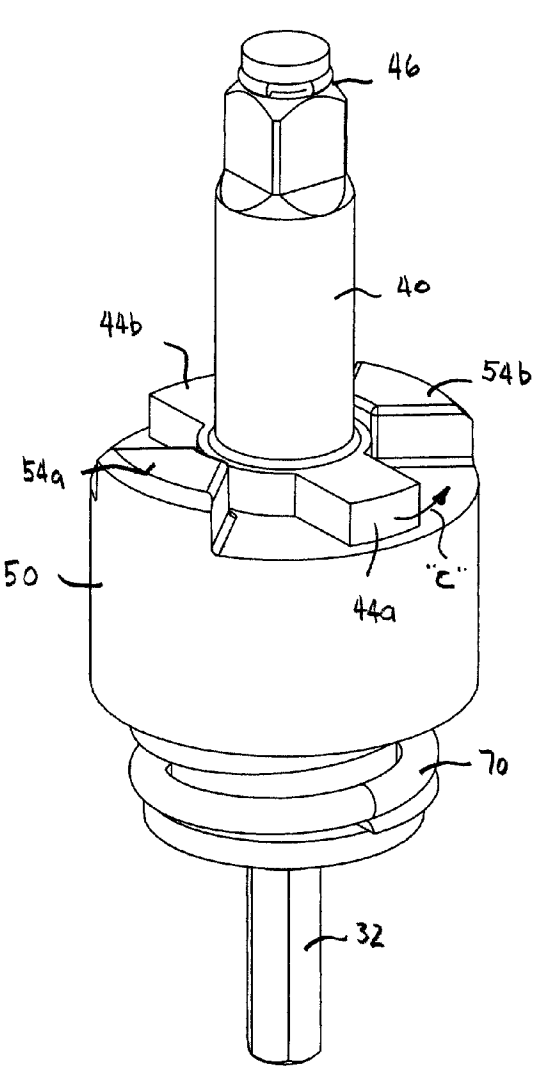
FIG. 16 is a perspective view similar to FIG. 15, but with the hammer member moving forwardly and rotationally to its anvil contact position on the next anvil.

When the hammer member 50 reaches the release position, the hammer member 50 is forcefully propelled, as indicated by arrow "B" in FIG. 14, by the rotation of the drive engaging member 30, across the anvil portion 44. When the hammer member 50 fully passed as the present anvil portion 44, as can be seen in FIG. 15, the hammer member 50 is forcefully propelled by the spring means 70 and the rotation of the drive engaging member 30, as indicated by arrow "C" in FIG. 16, to impact on the next anvil portion 44 (identical to FIG. 11), thus urging the tool bit retaining member 40 to forcefully rotate about the longitudinal axis.

Reference will now be made to FIGS. 17 through 19, which show a second preferred embodiment of the impact mechanism of the present invention, as indicated by general reference numeral 220. The second preferred embodiment impact mechanism 220 is similar to the first preferred embodiment impact mechanism 20 except that the second preferred embodiment impact mechanism 220 further comprises a somewhat modified housing 280 substantially surrounding the drive engaging member 230 forwardly of the chuck-engageable portion 232, the anvil portion 244 of the tool bit retaining member 240, the hammer member 250, and the spring means 270. The housing 280 comprises an outer annular portion 282, a front end portion 284, and a back end portion 286. The front end portion 284 bears against a forward facing surface 241 on the tool bit retaining member 240 and the back end portion 286 bears against a rearwardly facing surface 230*a* on the drive engaging member 230, to thereby retain the housing 280 in place and to keep the tool bit retaining member 240 operatively inter-connected with the drive engaging member 230.

The second preferred embodiment impact mechanism 220 further comprises a selectively adjustable spring compression mechanism 290, for permitting selective compression of the spring means 270. The selectively adjustable spring compression mechanism 290 comprises an externally threaded annular main body member 291 threadibly engaged in a co-operating threaded aperture 286*a* in the back end portion 286 of the housing 280, and a manually manipulable handle 292 secured to the externally threaded annular main body member 291 so as to be disposed exteriorly to the housing 280. The externally threaded annular main body member 291 operatively engages the spring means 270, to thereby permit selective compression of the spring means 270 through rotation of the manually manipulable handle 292.

The impact mechanism 220 further comprising a spring receiving plate 294 disposed between the externally threaded annular main body member 291 and the spring means 270.

In use, as the manually manipulable handle 292 is rotated clockwise, the spring means 270 is compressed, thus causing greater potential energy to be stored in the spring means 270. Accordingly, when the spring means 270 is further compressed by the predetermined distance that is equal to the movement of the hammer member from its anvil contact position to its release position, it stores more potential energy than at a lesser spring compression. Resultingly, the hammer member 250 impacts against the anvil portion 244 with greater force.

Conversely, as the manually manipulable handle is rotated counter-clockwise, the spring means 270 is de-compressed.

In another alternative embodiment, it is contemplated that the adjustment of the compression of the spring means could be accomplished by a threaded fastener that is inset within the housing, and that the back end portion of the housing would need to be removed in order to adjust the compression of the spring means. In order to make this adjustment, it might be necessary to place the impact driver in a vise, and then use a screwdriver or Allen key, or the like, to adjust the threaded fastener. In this manner, the compression of the spring means would not be inadvertently altered.

It is also contemplated that the compression of the spring means could be adjusted through the use of a gearing system.

As can be understood from the above description and from the accompanying drawings, the present invention provides a portable impact driver that is operatively engageable with the chuck of an electric drill or the like, which portable impact driver provides a high impact rotational force, and wherein it is possible to readily adjust the impact rotational force of the portable impact driver, all of which features are unknown in the prior art.

Other variations of the above principles will be apparent to those who are knowledgeable in the field of the invention, and such variations are considered to be within the scope of the present invention. Further, other modifications and alterations may be used in the design and manufacture of the impact mechanism of the present invention without departing from the spirit and scope of the accompanying claims.

We claim:

1. An impact mechanism for use with a drive motor, said impact mechanism comprising:

a drive engaging member for engaging a rotatable output of a drive motor for rotation therewith about a longitudinal axis;

a tool bit retaining member operatively inter-connected with said drive engaging member for rotation with respect to said drive engaging member about said longitudinal axis, said tool bit retaining member having a main body portion, an anvil portion securely attached thereto for co-rotation with said main body portion, and a tool bit retaining means securely attached thereto for co-rotation with said main body portion;

a hammer member mounted on one of said drive engaging member and said tool bit retaining member for movement between an anvil contact position whereat force is transmitted from said hammer member to said anvil portion so as to create a moment about said longitudinal axis, and a release position whereat said hammer member is temporarily removed from said anvil portion;

guide means for moving said hammer member between said anvil contact position and said release position when said drive engaging member is rotated with respect to said tool bit retaining member;

spring means operatively interconnected between said drive engaging member and said hammer member for biasing said hammer member to said anvil contact position;

wherein, in use, rotation of said drive engaging member about said longitudinal axis causes said hammer member to move from its anvil contact position towards its release position, thereby storing potential energy in said spring means; and, wherein, when said hammer member reaches said release position, said hammer member is forcefully propelled by said spring means and the rotation of said drive engaging member to impact on said anvil portion, thus urging said tool bit retaining member to forcefully rotate about said longitudinal axis.

2. The impact mechanism of claim 1, wherein said drive engaging member comprises a chuck-engageable portion.

3. The impact mechanism of claim 1, wherein said drive engaging member is disposed immediately rearwardly of said tool bit retaining member.

4. The impact mechanism of claim 3, wherein said tool bit retaining member has a rear recess therein at said longitudinal axis and said drive engaging member has a front cylindrical protrusion shaped and dimensioned for free rotational engagement in said rear recess of said tool bit retaining member.

5. The impact mechanism of claim 4, wherein said drive engaging member further comprises a forward shaft portion.

6. The impact mechanism of claim 5, wherein said forward shaft portion is disposed immediately rearwardly of said front cylindrical protrusion.

7. The impact mechanism of claim 6, wherein said drive engaging member further comprises an intermediate shaft portion disposed between said forward shaft portion and said chuck-engageable portion.

8. The impact mechanism of claim 7, wherein said forward shaft portion is substantially cylindrical.

9. The impact mechanism of claim 8, wherein said guide means is disposed on said forward shaft portion.

10. The impact mechanism of claim 8, wherein said guide means comprises a "V"-shaped groove in the outer surface of said forward shaft portion, a race in an interior surface of said hammer member, and a ball bearing operatively engaging said "V"-shaped groove and said race.

11. The impact mechanism of claim 7, wherein said intermediate shaft portion is substantially cylindrical.

12. The impact mechanism of claim 11, wherein said intermediate shaft portion has a larger diameter than said forward shaft portion.

13. The impact mechanism of claim 12, wherein said spring means comprises a coil spring.

14. The impact mechanism of claim 13, wherein said coil spring fits in close relation around said intermediate shaft portion.

15. The impact mechanism of claim 1, wherein said hammer member has an annular main body and at least one hammer head portion projecting forwardly from said annular main body.

16. The impact mechanism of claim 15, wherein said at least one hammer head portion comprises first and second hammer head portions projecting forwardly from said annular main body.

17. The impact mechanism of claim 16, wherein said annular main body and said first and second hammer head portions are integrally formed one with the others.

18. The impact mechanism of claim 1, wherein said hammer member is more massive than said anvil portion of said tool bit retaining member.

19. The impact mechanism of claim 1, wherein said drive engaging member further comprises a spring retaining disk portion projecting radially outwardly from said intermediate shaft portion, and wherein said spring means is received and retained between said spring retaining disk portion and said hammer member.

20. The impact mechanism of claim 19, wherein said spring means is in compression when said impact mechanism is at rest.

21. The impact mechanism of claim 1, wherein said anvil portion is integrally formed with said tool bit retaining member.

22. The impact mechanism of claim 21, wherein said anvil portion comprises first and second squared anvils each projecting radially outwardly from said main body portion of said tool bit retaining member.

23. The impact mechanism of claim 22, wherein said first and second squared anvils at the back end of said tool bit retaining member.

24. The impact mechanism of claim 1, further comprising a housing substantially surrounding said drive engaging member forwardly of said chuck-engageable portion, said anvil portion of said tool bit retaining member, said hammer member, and said spring means.

25. The impact mechanism of claim 24, wherein said housing comprises an outer annular portion, a front end portion, and a back end portion, and wherein said front end portion bears against a forward facing surface on said tool bit retaining member and said back end portion bears against a rearward facing surface on said drive engaging member, to thereby retain said housing in place and to keep said tool bit retaining member operatively inter-connected with said drive engaging member.

26. The impact mechanism of claim 25, further comprising a selectively adjustable spring compression mechanism, for permitting selective compression of said spring means.

27. The impact mechanism of claim 26, wherein said selectively adjustable spring compression mechanism comprises an externally threaded annular main body member threadibly engaged in a co-operating threaded aperture in said back end portion of said housing, and a manually manipulable handle secured to said externally threaded annular main body member so as to be disposed exteriorly to said housing, wherein said externally threaded annular main body member operatively engages said spring means, to thereby permit selective compression of said spring means through rotation of said manually manipulable handle.

28. The impact mechanism of claim 27, further comprising a spring receiving plate disposed between said externally threaded annular main body member and said spring means.

* * * * *